US006337443B1

(12) United States Patent
Dlugas et al.

(10) Patent No.: US 6,337,443 B1
(45) Date of Patent: Jan. 8, 2002

(54) HIGH-FREQUENCY COAXIAL CABLE

(75) Inventors: Wolfgang Dlugas, Kierspe (DE); Henning Hansen, Shrewsbury, MA (US)

(73) Assignee: Eilentropp KG, Wipperfuerth (DE)

( * ) Notice: Subject to any disclaimer, the term of this patent is extended or adjusted under 35 U.S.C. 154(b) by 0 days.

(21) Appl. No.: 09/556,939

(22) Filed: Apr. 21, 2000

(30) Foreign Application Priority Data

Apr. 23, 1999 (DE) ..... 199 18 539

(51) Int. Cl.[7] ..... H01B 7/00
(52) U.S. Cl. ..... 174/120 R
(58) Field of Search ..... 174/120 R, 36, 174/110 FC, 110 F, 108

(56) References Cited

U.S. PATENT DOCUMENTS 4,477,693 A * 10/1984 Krabec et al. ..... 174/36
5,210,377 A * 5/1993 Kennedy et al. ..... 174/36 X
5,293,001 A * 3/1994 Gebs ..... 174/36
5,750,931 A * 5/1998 McGregor et al. ... 174/120 R X
5,817,981 A 10/1998 Arroyo ..... 174/110 N

FOREIGN PATENT DOCUMENTS

EP 0428622 B1 5/1991
EP 0489752 B1 6/1992

* cited by examiner

*Primary Examiner*—Chau N. Nguyen

(57) ABSTRACT

A high-frequency coaxial cable has a multi-layer insulation made of polymeric materials surrounding a central conductor and having an electrical shielding enclosing the insulation. The individual layers of the insulation are of fluoropolymers, with at least a first layer (2) that encloses the central conductor (1) being made of a fluoropolymer capable of being formed from a melt and an outer second layer (3) being made of a fluoropolymer not formable from a melt. In this cable, the second layer (3) is porous and is interengagedly connected with the surrounding shield (4).

20 Claims, 1 Drawing Sheet

HIGH-FREQUENCY COAXIAL CABLE

BACKGROUND OF THE INVENTION

This invention relates to a high-frequency coaxial cable. The coaxial able of the present invention has multiple layers of insulation formed of polymeric materials surrounding a central conductor, and has electrical shielding enclosing the insulation. An outer sheath covers the electrical shielding.

Cables of this general type are commonly known, and are used generally in high-frequency technology for transmitting analog and digital signals. U.S. Pat. No. 5,817,981 discloses a high-frequency coaxial cable in which insulation surrounding a central conductor comprises two layers that differ with respect to dielectric constant. In U.S. Pat. No. 5,817,981, the dielectric constant of the second layer is greater than that of the first layer, with the first layer being formed of a polyethylene and the second layer being formed of a polyimide.

With increasing miniaturization of technical equipment, however, demands are being placed on coaxial cables that cannot be met through solutions known in the prior art. For instance, modern transmission technology requires lightweight connecting lines having extremely small external dimensions but exceptional electrical transmission properties. Moreover, these transmission properties must also be largely independent of outside environmental influences.

In order to meet these requirements, European patent document EP 0 428 622 B1 teaches the manufacture of a high-frequency coaxial cable insulation formed of polytetrafluoroethylene in such a way that a number of strands of porous expanded polytetrafluoroethylene are wrapped around a central conductor in such a way as to form a uniform insulation. This requires a technically complex manufacturing process. Moreover, further miniaturization down to "micro coaxial cables" having an overall outer diameter of less than 2 mm encounters significant difficulties.

SUMMARY OF THE INVENTION

An object of the present invention is to provide for further improvement in the transmission properties of such micro coaxial cables despite the required minimal external dimensions. A particular object of the present invention is to reduce capacitance of the transmission path as much as possible.

These and other objects of the present invention are achieved by providing individual layers of insulation made of fluoropolymers, with at least an inner first layer that encloses a central conductor comprising a melt-formable fluoropolymer from a melt and an outer second layer consisting of a fluoropolymer that is not manufactured from a melt, the second layer being porous and non-positively connected with the surrounding shield. By using two or more fluoropolymer insulation layers for the insulator of the cable in accordance with the present invention, it is possible to adjust the dielectric constant of the insulation the respective requirements, particularly to set low dielectric constant levels, without having recourse entirely to foam insulation. This permits the manufacture of cables with very small external dimensions.

Examples of fluoropolymers than can be manufactured from a melt, i.e., extruded, are tetrafluoroethylene/hexafluoropropylene copolymer (FEP), tetrafluoroethylene-perfluoroalkylvinylether copolymer (TFA/PFA), and HYFLON MFA fluoropolymer. The inner layer can be made compact or as a foam. The wall thickness of this first layer ranges advantageously from about 0.8 through 0.1 mm, preferably from about 0.3 through 0.2 mm, depending on the intended use of the cable.

The second insulation layer adjoining the first is porous, having a microporous structure, as disclosed in European patent document EP 0 489 752 B1. The wall thickness of this second layer ranges advantageously from about 0.8 through 0.2 mm, preferably from about 0.4 through 0.3 mm, again depending on the intended use of the cable. It is advantageous if the dielectric constant of the first layer is greater than that of the second layer.

For compacting the insulation and for further increasing the flexibility of the cable while maintaining the electrical properties at least unchanged, it is often advantageous to glue the two layers to each other.

Particular advantages arise if, according to this invention, in a two-layer insulation the first layer surrounding the central conductor consists of a fluoropolymer that can be manufactured from a melt and the outer, porous second layer consists of a fluoropolymer that is not manufactured from a melt.

This combination of materials in connection with the shielding connected in a non-positive manner with the porous layer leads to a low-capacitance micro coaxial cable having low tolerance of characteristic impedance, low power attenuation, and low interaction impedance in this transmission means.

Further improvements of the cable in accordance with the present invention are obtained if the outermost porous layer, or in the case of a two-layer construction of the insulation, the outer layer, comprises a one-layer or a multiple-layer lapping made of a porous tape. The term "tape" in the context of the present invention includes film. Such tape or films may be, for example, polyester-based porous and/or foam films. However, tapes (films) of polytetrafluoroethylene are preferably used.

A tape of this type is stretched and sintered in order to guarantee the porous character of the tape. In this process, the microporous character of the tape material is important. In order to assure microporosity, the tape—for example comprising a polytetrafluoroethylene manufactured by means of paste extrusion followed by rolling, or a polytetrafluoroethylene modified with no more than 2% by weight of fluoromonomers—is subject to a stretching process with a stretch rate of up to 2000%, preferably from 300% through 1000%. The stretching is generally conducted in the direction of the tape, but it can also be done transversely with respect thereto, for instance if the porosity of the tape or of foil is to be increased.

The mechanical strength of the tape of foil material is increase by means of a sintering process that takes place simultaneously with the stretching process or downstream from the stretching process. The thickness of the stretched and advantageously also sintered tape or corresponding foil is then about 15 $\mu$m through 250 $\mu$m, preferably 30 $\mu$m through 100 $\mu$m.

In the case of lapping, for purposes of the present invention it is important that at least its outermost tape layer be connected in a non-positive manner with the surface of the electrical shielding facing toward it. This is achieved, for example, by using a hot-melt-type adhesive. The adhesive can be applied by being sprayed on, for instance, for achieving non-positive connection between a conductive plastic or metal foil, or in a further development of this invention, by using an adhesive-coated metal foil as an electrical shield. Aluminum foil coated with polyester has proven advantageous as a metal foil in this context.

The non-positive connection between the porous outermost layer of the insulation and the conductive shielding is generally achieved during extrusion of the outer sheathing of the cable, owing to its heat content. This is particularly true if, as provided according to the invention, the outer sheathing consists of a fluoropolymer having a correspondingly high melting/extrusion temperature of, for instance, 350° C. Such temperatures in the outer area of the cable effect a melting on of the adhesive layer between the porous insulation and the electrical shield. The adhesive then intersperses with the pores of at least the outermost layer of a lapping comprising a stretched foil that serves as a second layer of the cable insulation, for example. When the outer sheathing cools, the shrinkage effect associated therewith, particularly with regard to fluoropolymers, solidly anchors the sheathing to the cable insulation by a multiplicity of adhesion points. This anchoring is permanent, even with regard to large temperature fluctuations and relevant operating temperatures, as well as when the cable is under mechanical stress. Furthermore, therefore, any crimping or wrinkling of a thin aluminum foil, which would necessarily lead to a deterioration of the electrical transmission properties, is avoided. This also applies for micro coaxial cable for transmitting analog and digital signals with correspondingly small external dimensions.

If the heat content of the extruded outer sheathing is insufficient for forming a secure connection between the porous insulation, owing for instance to the amount of extruded mass per unit of length being too small or to the polymer materials used as the outer sheathing having a low melting/extrusion temperature, then an additional heat treatment is recommended following the application of the electrical shielding. This is because a significant feature of the coaxial cable according to the present invention is the mechanically fixed all-surface connection between, for example, a metal foil and the outermost porous insulation layer of the cable.

The shielding of the cable is advantageously structured in two layers. Outward of the above-described adhesive-coated metal foil or metallized plastic foil, an outer layer in the form of a metal wire layer or a braided covering comprising individual metal wires is provided. Outward of that is located the outer sheathing, which can be made from fluoropolymers or halogen-free flame resistant polymer materials or flame resistant, anti-corrosive polymer materials, such as polyolefins, elastomers, or thermoplastic rubber. This two-layer shielding has the advantage of improved shielding properties at the same time as high flexibility of the cable.

BRIEF DESCRIPTION OF THE DRAWINGS

The foregoing and other objects, features, and advantages of the invention will be apparent from the following more particular description of a preferred embodiment of the invention, as illustrated in the accompanying drawings, in which reference characters refer to the same parts throughout the different views. The drawing is not necessarily to scale, emphasis instead being placed upon illustrating principles of the invention in a clear manner.

More particularly, the present invention is described and explained in more detail hereinbelow using an embodiment of a miniaturized high-frequency coaxial cable having a two-layer insulation. The features of the invention that are drawn and described in this embodiment can be used individually or in preferred combinations in other embodiments of the invention that will occur to those skilled in the art based upon the pre sent disclosure.

DESCRIPTION OF A PREFERRED EMBODIMENT

Figure 1:
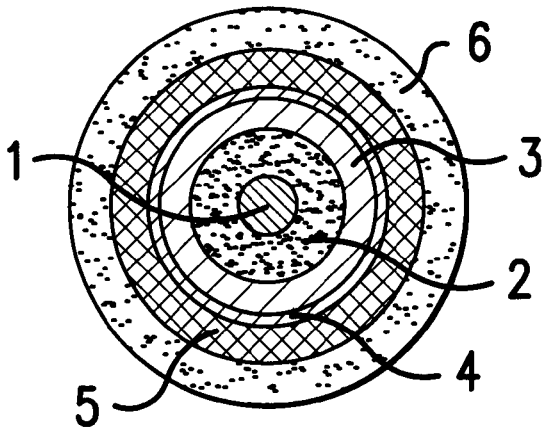
FIG. 1 shows a cross-sectional view of a cable according to the present invention.
Figure 2:
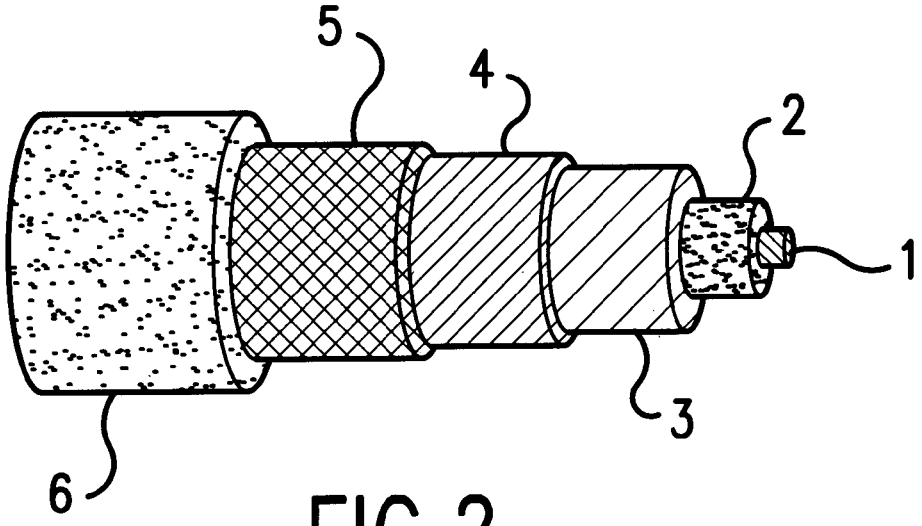
FIG. 2 shows a longitudinal section of the cable of FIG. 1.

A solid copper wire, advantageously solder-coated or silver-coated, is provided as a central conductor 1. A stranded conductor comprising bare or solder-coated copper wire may, of course, be used instead of the solid copper wire. In the present example, the diameter of the central conductor is approximately 0.254 mm.

The central conductor 1 is surrounded by an inner or first layer 2 formed rom a tetrafluoroethylene/hexafluoropropylene copolymer (FEP) that is produced from a melt, in other words, extruded. This first insulation layer has a all thickness of 0.225 mm, and is made to be compact in this embodiment.

A second, and thus exterior, insulation layer 3 includes a lapping having a thickness of 0.3 mm and is made of several layers of a polytetrafluoroethylene tape. The polytetrafluoroethylene tape is made by a paste extrusion followed by rolling followed by a stretching and temperature treatment for purposes of sintering. Pores are created in the tape by the stretching process. These pores serve as air chambers in the lapping, for reducing the dielectric constant and for improving electrical transmission properties. Open pores in the outermost layer of the tape lapping serve for providing all-surface anchoring of an aluminum foil 4 that is coated with polyester or an adhesive.

A second layer 5 of the shielding is a layer/braided covering of solder-coated copper wires. An outer sheathing 6 formed from a tetrafluoroethylene/hexafluoropropylene copolymer (FEP) encloses layer 5 of the shielding.

The outer diameter of this multi-layer high-frequency coaxial cable in this embodiment example is approximately 2.00 mm. Thus, this embodiment provides a coaxial cable having extremely small external dimensions. The cable is highly flexible and has high mechanical strength and endurance of transmission properties, even with variable temperature demands.

The cables of this invention are distinguished, among other reasons, by their low tolerance of characteristic impedance, as well as low operating capacitance. Thus, for example, a 75 Ohm cable according to the present invention has an operating capacitance of <60 nF/km. Attenuation is, for example: at 1 MHz, 2.3 dB/100 m; at 100 MHz, 27.7 dB/100 m; and at 500 MHz, 67.9 dB/100 m.

Based upon the description and specific embodiments set forth hereinabove, persons skilled in the art will be enabled to understand the essential features of the present invention, and—without departing from the scope and spirit thereof—to adapt the invention to alternate conditions and usage.

What is claimed is:

1. A high-frequency coaxial cable comprising a central conductor component (1) surrounded by a multilayer insulation component (2, 3) comprising polymeric materials, said multilayer insulation component being surrounded by an electrical shielding component (4, 5), said electrical shielding component being surrounded by an outer sheathing component (6), wherein individual layers of the multilayer insulation component are formed of fluoropolymers, with at least an inner first layer (2) of said multilayer insulation component that directly encloses the central conductor (1) comprising a fluoropolymer formed from a melt and with at least an outer second layer (3) of said multilayer insulation component comprising a fluoropolymer not formed from a melt, and wherein said second layer (3) is porous stretched polytetrafluoroethylene tape and is inter-engagedly connected with an inner adjacent layer (4) of the electrical shielding component.

2. The cable of claim 1, wherein the first layer (2) of the multilayer insulation component has a thickness of 0.8 to 0.1 mm.

3. The cable of claim 2, wherein the first layer (2) of the multilayer insulation component has a thickness of 0.3 to 0.2 mm.

4. The cable of claim 1, wherein the second layer (3) of the multilayer insulation component has a thickness of 0.8 to 0.2 mm.

5. The cable of claim 4, wherein the second layer (3) of the multilayer insulation component has a thickness of 0.4 to 0.3 mm.

6. The cable of claim 4, wherein the second layer (3) of the multilayer insulation component comprises a single-layer or a multi-layer lapping made as a porous tape.

7. The cable of claim 6, wherein at least an outermost tape layer of the lapping comprising said second layer (3) is connected in an inter-engaged manner with said inner adjacent layer (4) of said electrical shielding component (4,5).

8. The cable of claim 7, wherein said connection in an inter-engaged manner is achieved by means of an adhesive.

9. The cable of claim 8, wherein said inner adjacent layer (4) of said electrical shielding component (4,5) is an adhesive-coated metal foil.

10. The cable of claim 9, wherein the adhesive-coated metal foil is an aluminum foil having a polyester coating.

11. The cable of claim 1, wherein the stretched polytetrafluoroethylene tape is sintered.

12. The cable of claim 1, wherein the stretched polytetrafluoroethylene tape has a thickness of 15–250 $\mu$m.

13. The cable of claim 12, wherein the stretched polytetrafluoroethylene tape has a thickness of 30–100 $\mu$m.

14. The cable of claim 1, wherein the first layer (2) of the multilayer insulation component comprises a foamed fluoropolymer.

15. The cable of claim 1, wherein the electrical shielding component comprises two layers, with said inner adjacent layer (4) comprising an adhesive-coated metal foil (4) and an outer layer (5) comprising a metal wire layer or a braided covering comprising individual metal wires.

16. The cable of claim 1, wherein said electrical shielding component (4, 5) is surrounded by the outer sheathing component (6) comprising a fluoropolymer.

17. The cable of claim 1, wherein said electrical shielding component (4, 5) is surrounded by the outer sheathing component (6) comprising a halogen-free, flame resistant polymer material or a flame resistant, anti-corrosive polymer material.

18. The cable of claim 1, wherein adhesion of said electrical shielding component (4,5) to said porous insulation layer (3) is promoted by heat emanating from said outer sheathing component (6) when said outer sheathing component (6) is applied to the exterior of the cable.

19. The cable of claim 1, wherein said multilayer insulation component (2, 3) consists essentially of said first and second layers that are glued together.

20. A high-frequency coaxial cable comprising a central conductor component (1) surrounded by a multilayer insulation component (2, 3) comprising polymeric materials, said multilayer insulation component being surrounded by an electrical shielding component (4, 5), said electrical shielding component being surrounded by an outer sheathing component (6), wherein individual layers of the multilayer insulation component are formed of fluoropolymers, with at least an inner first layer (2) of said multilayer insulation component that directly encloses the central conductor (1) comprising a fluoropolymer formed from a melt and with at least an outer second layer (3) of said multilayer insulation component comprising a fluoropolymer not formed from a melt and wherein the dielectric constant of said first insulation layer (2) is greater than the dielectric constant of said second insulation layer (3), and wherein said second layer (3) is porous and is inter-engagedly connected with adjacent layer (4) of the electrical shielding component.

* * * * *